United States Patent [19]

Potter

[11] 4,058,148

[45] Nov. 15, 1977

[54] VAPOR HOSE HOOKUP ASSURANCE

[75] Inventor: Gordon C. Potter, Houston, Tex.

[73] Assignee: Exxon Research & Engineering Co., Linden, N.J.

[21] Appl. No.: 668,549

[22] Filed: Mar. 18, 1976

[51] Int. Cl.[2] ..... B65B 3/26

[52] U.S. Cl. ..... 141/198; 141/290; 141/349

[58] Field of Search ..... 141/45, 46, 52, 53, 141/59, 290, 346-390, 331-362, 198-229; 55/74, 387; 220/85 VR, 85 VS, 86 R; 62/94

[56] References Cited

U.S. PATENT DOCUMENTS 3,776,283 12/1973 Krammer et al. ..... 141/45

*Primary Examiner*—Houston S. Bell, Jr.
*Attorney, Agent, or Firm*—John S. Schneider

[57] ABSTRACT

In the delivery of bulk gasoline to an underground storage tank assurance that the vapor recovery hose is properly connected is provided by sensing of an excess vacuum in the delivery truck tank. Such vacuum occurs when air and/or gasoline vapor is not permitted to replace the gasoline drained from the truck tank. To prevent air from entering the truck tank when the vapor hose is not properly connected to both the truck tank and the storage tank (1) a complete dry break coupling is employed at the vapor hose connection to the underground tank so that vapor cannot be displaced from the storage tank nor can air enter the vapor hose if that connection is not made and (2) a dry break coupling is used only on the truck side of the vapor hose connection to the truck so that air cannot enter the truck tank unless that connection is made. To prevent discharge of gasoline from the truck tank when the vapor hose is not properly connected to both the truck tank and the storage tank a vacuum sensor, similar to that used for automatic service station automobile refueling nozzles, is mounted on the truck vapor line near the connection of the truck vapor line to the vapor hose. The vacuum sensor is attached to a standard air control valve on the air supply line in series with bottom dump (emergency) valves in compartments of the truck tank. If the hose is not properly connected, the vacuum created causes the air valve to close and in turn the compartment dump valves to close preventing further flow of gasoline.

2 Claims, 3 Drawing Figures

VAPOR HOSE HOOKUP ASSURANCE

BACKGROUND OF THE INVENTION

This invention relates to a gasoline vapor recovery system and, more particularly, to a system which assures proper connections for the vapor recovery hose used in making bulk gasoline delivery.

When underground gasoline storage tanks at service stations are filled a substantial volume of air loaded with gasoline vapors, which is a source of pollution, is displaced from the storage tank at a high rate. As the compartments on the gasoline tank trucks are emptied air is drawn into those compartments to replace the gasoline discharged from them.

The present system eliminates the need for an orifice and pressure vacuum valve on the storage tank vent and, in addition, significantly deters any tendency to release pressure from the storage tank when the vapor hose is not connected by blocking open the dry break valve on the underground tank vent riser. The latter is of particular importance because of the severe hazard of venting gasoline vapors from the underground storage tank at ground level.

SUMMARY OF THE INVENTION

The system of the invention provides means designed to prevent air from entering a gasoline delivery truck tank when the vapor hose is not properly connected to both the truck tank and the storage tank and includes a complete dry break coupling at the vapor hose connection to the storage tank to ensure that vapor cannot be displaced from the storage tank nor air enter the vapor hose if the connection is not made; and a dry break on the truck side only of the vapor hose connection to the truck so that air cannot enter the truck tank unless the connection is made; and means to prevent liquid discharge from the truck tank when the vapor hose is not properly connected to both the truck tank and the storage tank which includes a vacuum sensor mounted on the truck vapor line adjacent connection thereof to the vapor hose and attached to a standard air control valve on an air supply line in series with tank compartment bottom dump valves.

DESCRIPTION OF THE PREFERRED EMBODIMENTS

Figures 1, 2, 3:
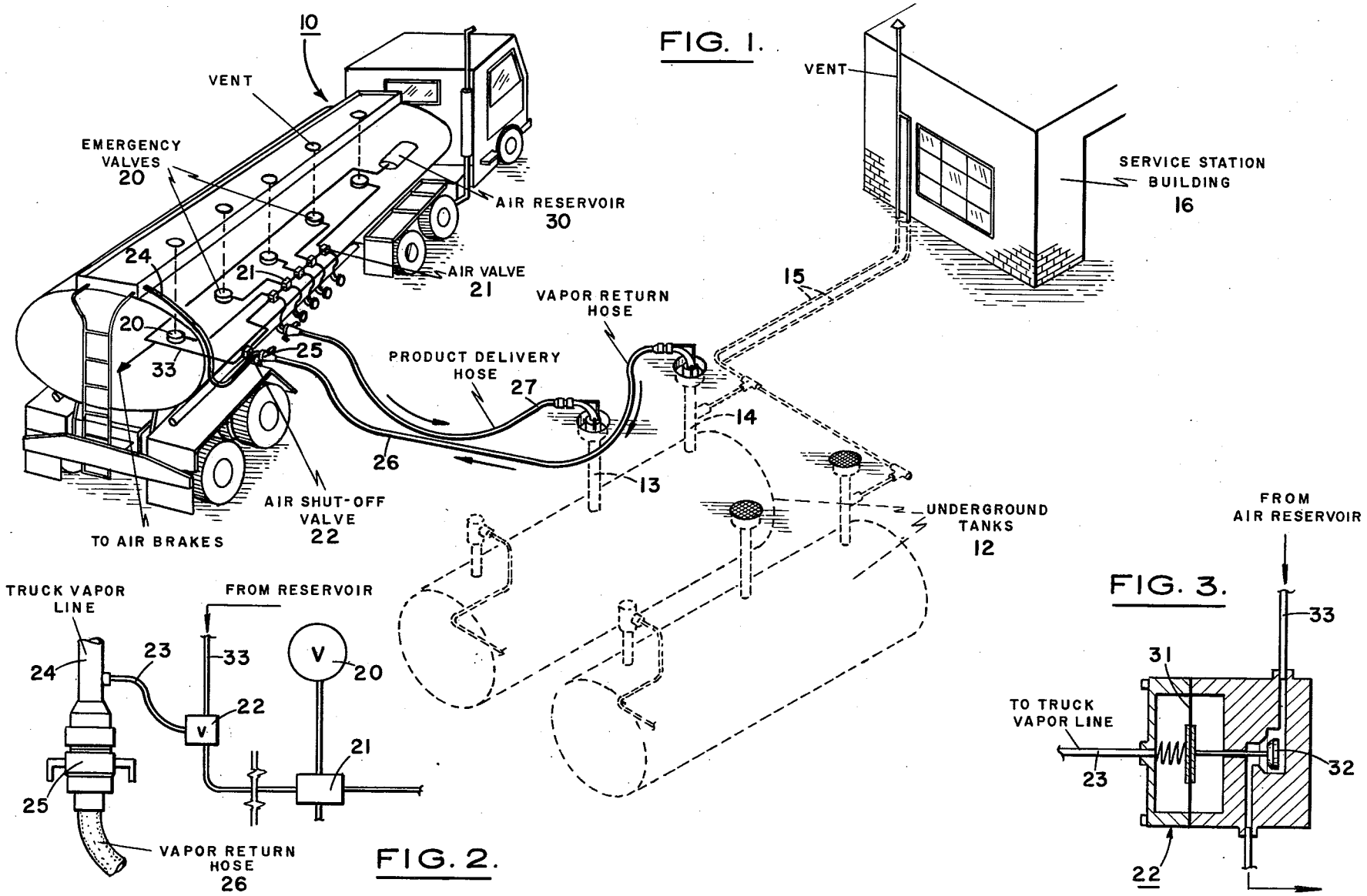
FIG. 1 is a schematic illustration of the delivery tank truck, underground storage tanks and hose connections thereto.
FIG. 2 is a schematic illustration of the connection of the vapor hose to the truck tank and associated vacuum sensor, valves and lines.
FIG. 3 is a schematic more detailed illustration of the vacuum actuated air shut-off valve of FIGS. 1 and 2.

Referring to FIG. 1 a bulk gasoline delivery tank truck 10 is shown connected for delivery of gasoline to underground storage tanks 12 each having fill pipes 13 and vapor return pipes 14 mounted thereon. Vent pipes 14 connect to vent lines 15 which vent to the atmosphere, as indicated, at a service station building 16. Truck 10 contains a series of tank compartment dump (emergency) valves 20 which are operated by air control valves 21 (see also FIG. 2) which in turn are controlled by a vacuum actuated air shut-off valve 22 controlled by the vacuum sensing line 23 attached to the truck vapor line 24. A dry break coupling 25 connects vapor line 24 (which is also connected to the compartments of the tank truck) to the vapor return hose 26 which is connected to a vapor return pipe 14 of a storage tank 12. A dry break coupling contains a valve in each half of the coupling arranged such that the coupling must be connected before the valves can be opened. Conversely, the valves must be closed before the coupling can be disconnected. A product delivery hose 27 connects one of the fill pipes 13 of tank 12 to one of the dump valves 20. An air reservoir 30 on truck 10 is connected to shut-off valve 22 and to air control valves 21. Air shut-off valve 22, as seen in FIG. 3, is controlled by a spring biased diaphragm 31 which causes a valve element 32 to open and close air line 33. Valve 22 is a standard air valve commonly used on trucks which has an activating rod extended and so positioned as to be operated by the hose coupling as it is engaged with the truck.

In operation, air must pass through vacuum sensor activated valve 22 to reach control valves 21 which control dump valves 20. Vacuum sensor activated valve 22 is opened by the action of connecting vapor hose 26 to the truck vapor line 24. Therefore, unless vapor hose 26 is connected dump valves 20 cannot open. If vapor hose 26 is attached to the truck but not to vapor return pipe 14 of storage tank 12 the dry break in the storage tank end of vapor hose 26 will prevent air from entering the truck tank as gasoline flows out of the truck tank. A vacuum will then quickly develop, vacuum sensor 22 will sense that vacuum and shut off the air supply to control valves 21 and dump valves 20. The latter will automatically close and stop flow of gasoline.

When vapor hose 26 is properly connected tests have shown that with two truck compartments flowing together the vacuum in the truck will be less than two inches of water (about 1.15 ounces). The vacuum relief valves in most trucks are set at six ounces. Consequently, the vacuum sensor is set at four ounces thereby giving a wide tolerance for sensitivity in either direction.

With an 8,000 gallon full truck load, three percent outage and normal beginning flow rates around 500 gpm, flow from one truck compartment without air or vapor in-flow will create the four ounce vacuum in about one-half second and flow will stop before fifteen gallons has been discharged. With a split dump or delivery, reaction time will be longer depending on the empty space in the truck. Gasoline trucks are compartmentized into, for example, four to seven compartments varying in size from 500 to 2500 gallons so that varying amounts of three different gasoline grades can be delivered in one trip according to the dealer's needs. A split delivery is one in which only some of the compartments of an 8000 or 9000 gallon truck are unloaded at one station while the remainder are taken to another. Because the vapor space in the truck is common through the vapor return line, the effect of a split delivery is to start the second delivery with a relatively large vapor space, 4000 gallons in the case noted above. Thus, even a very large vapor space can be handled with this apparatus before a significant amount of liquid has been discharged from the truck. As an indication of reaction time assume an equally divided split delivery i.e., 4,000 gallons has been unloaded elsewhere and 4,000 gallons remain to be unloaded. Reaction time will be about 10 seconds and less than 80 gallons will be discharged before flow is stopped.

While this system is more easily applied to trucks with air operated dump valves, trucks with mechanically operated valves can also be adapted to the system. A typical method would be to trigger a seat release by the vacuum sensor to release the mechanical valve linkage. Also, while particularly adaptable to discharge of gasoline from tank trucks the system is applicable to the transfer of other volatile liquids.

Other variations in the embodiment of the invention may be made without departing from the spirit and scope of the invention as defined in the appended claims.

Having fully described the apparatus, objects, advantages and operation of my invention, I claim:

1. Apparatus to assure proper vapor hose hookup in the transfer of a volatile liquid from a truck tank to a storage tank comprising:

a dump valve on said truck tank;

a fill pipe on said storage tank;

a delivery hose for connecting said dump valve and said fill pipe;

a vapor line on said truck tank;

a vapor line on said storage tank;

a vapor return hose for connecting said truck tank vapor line and said storage tank vapor line;

control means connected to said dump valve capable of being actuated to open and close said dump valve; and vacuum sensor means connected to said truck tank vapor line and to said control means for actuating said control means to close said dump valve when a predetermined vacuum occurs in said truck tank vapor line.

2. Apparatus as recited in claim 1 in which said vapor hose connection to said storage tank comprises a dry break coupling which prevents vapor and air from entering said vapor hose when said vapor hose-storage tank connection is not made; and said vapor hose connection to said truck being a dry break coupling on the truck tank side only of said connection so that air/vapor cannot enter said truck tank unless said vapor hose-truck tank connection is made.

* * * * *